US008695733B2

(12) United States Patent
Fang et al.

(10) Patent No.: US 8,695,733 B2
(45) Date of Patent: Apr. 15, 2014

(54) FUNCTIONALLY GRADED POLYCRYSTALLINE DIAMOND INSERT

(75) Inventors: Yi Fang, Provo, UT (US); Federico Bellin, The Woodlands, TX (US); Michael Stewart, Provo, UT (US); Nephi A Mourik, Provo, UT (US); Peter T Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 356 days.

(21) Appl. No.: 12/851,593

(22) Filed: Aug. 6, 2010

(65) Prior Publication Data

US 2011/0042147 A1 Feb. 24, 2011

Related U.S. Application Data

(60) Provisional application No. 61/232,151, filed on Aug. 7, 2009.

(51) Int. Cl.
*E21B 10/36* (2006.01)
*E21B 10/46* (2006.01)
*E21B 10/567* (2006.01)

(52) U.S. Cl.
CPC ..... *E21B 10/46* (2013.01); *E21B 10/567* (2013.01)
USPC ..... 175/434; 175/420.2; 175/426; 175/430; 175/433; 75/243

(58) Field of Classification Search
USPC ..... 175/420.2, 426, 430, 432, 433, 434; 75/243
See application file for complete search history.

(56) References Cited

U.S. PATENT DOCUMENTS

| | | | |
|---|---|---|---|
| 2,941,241 | A | 6/1960 | Strong |
| 2,941,248 | A | 6/1960 | Hall |
| 2,947,611 | A | 8/1960 | Bundy |
| 3,609,818 | A | 10/1971 | Wentorf, Jr. |
| 3,767,371 | A | 10/1973 | Wentorf, Jr. |
| 4,224,380 | A | 9/1980 | Bovenkerk et al. |
| 4,289,503 | A | 9/1981 | Corrigan |
| 4,311,490 | A | 1/1982 | Bovenkerk et al. |

(Continued)

FOREIGN PATENT DOCUMENTS

| | | |
|---|---|---|
| EP | 0219959 | 4/1987 |
| EP | 0235455 A2 | 9/1987 |

(Continued)

OTHER PUBLICATIONS

International Search Report and Written Opinion dated Mar. 23, 2011 for corresponding PCT application No. PCT/US2010/044640 filed Aug. 6, 2010.
International Search Report and Written Opinion dated Mar. 30, 2011 for related PCT application No. PCT/US2010/044664 filed Aug. 6, 2010.

(Continued)

*Primary Examiner* — Cathleen Hutchins

(57) ABSTRACT

PCD inserts comprise a PCD body having multiple FG-PCD regions with decreasing diamond content moving from a body outer surface to a metallic substrate. The diamond content changes in gradient fashion by changing metal binder content. A region adjacent the outer surface comprises 5 to 20 percent by weight metal binder, and a region remote from the surface comprises 15 to 40 percent by weight metal binder. One or more transition regions are interposed between the PCD body and substrate. The transition region comprises PCD, binder metal, and a carbide, comprises a metal binder content less than that present in the PCD body region positioned next to it.

34 Claims, 4 Drawing Sheets

(56) References Cited

U.S. PATENT DOCUMENTS

| | | | |
|---|---|---|---|
| 4,604,106 | A | 8/1986 | Hall |
| 4,664,705 | A | 5/1987 | Horton et al. |
| 4,667,756 | A | 5/1987 | King et al. |
| 4,673,414 | A | 6/1987 | Lavens |
| 4,694,918 | A | 9/1987 | Hall |
| 4,789,385 | A | 12/1988 | Dyer et al. |
| 4,813,500 | A | 3/1989 | Jones |
| 4,954,139 | A | 9/1990 | Cerutti |
| RE33,757 | E | 12/1991 | Weaver |
| 5,290,507 | A | 3/1994 | Runkle |
| 5,370,195 | A | 12/1994 | Keshavan |
| 5,732,783 | A | 3/1998 | Truax et al. |
| 6,009,962 | A | 1/2000 | Beaton |
| 6,095,265 | A | 8/2000 | Alsup |
| 6,193,000 | B1 | 2/2001 | Caraway et al. |
| 6,199,645 | B1 | 3/2001 | Anderson |
| 6,241,036 | B1 | 6/2001 | Lovato et al. |
| 6,290,008 | B1 | 9/2001 | Portwood |
| 6,296,069 | B1 | 10/2001 | Lamine et al. |
| 6,371,226 | B1 | 4/2002 | Caraway |
| 6,375,706 | B2 | 4/2002 | Kembaiyan et al. |
| 6,443,248 | B2 | 9/2002 | Yong et al. |
| 6,458,471 | B2 | 10/2002 | Lovato et al. |
| 6,461,401 | B1 | 10/2002 | Kembaiyan et al. |
| 6,474,425 | B1 | 11/2002 | Truax et al. |
| 6,510,906 | B1 | 1/2003 | Richert et al. |
| 6,651,757 | B2 | 11/2003 | Belnap et al. |
| 6,725,953 | B2 | 4/2004 | Truax et al. |
| 6,742,611 | B1 | 6/2004 | Illerhaus et al. |
| 6,843,333 | B2 | 1/2005 | Richert et al. |
| 6,951,578 | B1 | 10/2005 | Belnap et al. |
| 7,234,550 | B2 | 6/2007 | Azar et al. |
| 7,350,599 | B2 | 4/2008 | Lockwood et al. |
| 7,350,601 | B2 | 4/2008 | Belnap |
| 7,377,341 | B2 | 5/2008 | Middlemiss et al. |
| 7,426,969 | B2 | 9/2008 | Azar |
| 7,469,757 | B2 | 12/2008 | Azar et al. |
| 7,497,280 | B2 | 3/2009 | Brackin et al. |
| 7,533,740 | B2 | 5/2009 | Zhang et al. |
| 7,575,425 | B2 | 8/2009 | Hall et al. |
| 7,757,793 | B2 | 7/2010 | Voronin et al. |
| 7,845,438 | B1 | 12/2010 | Vail et al. |
| 8,028,771 | B2 | 10/2011 | Keshavan et al. |
| 8,236,074 | B1 | 8/2012 | Bertagnolli et al. |
| 8,313,677 | B2 | 11/2012 | Hall et al. |
| 8,328,891 | B2 | 12/2012 | Zhang et al. |
| 2001/0000101 | A1 | 4/2001 | Lovato et al. |
| 2001/0002557 | A1 | 6/2001 | Kembaiyan et al. |
| 2001/0008190 | A1 | 7/2001 | Scott et al. |
| 2001/0047891 | A1 | 12/2001 | Truax |
| 2002/0125048 | A1 | 9/2002 | Traux et al. |
| 2003/0111273 | A1 | 6/2003 | Richert et al. |
| 2004/0037948 | A1 | 2/2004 | Tank |
| 2004/0154840 | A1 | 8/2004 | Azar et al. |
| 2004/0245022 | A1 | 12/2004 | Izaguirre et al. |
| 2005/0044800 | A1 | 3/2005 | Hall et al. |
| 2005/0133276 | A1 | 6/2005 | Azar |
| 2005/0133278 | A1 | 6/2005 | Azar |
| 2005/0230150 | A1 | 10/2005 | Oldham et al. |
| 2006/0032677 | A1 | 2/2006 | Azar et al. |
| 2006/0166615 | A1 | 7/2006 | Tank |
| 2006/0191723 | A1 | 8/2006 | Keshavan |
| 2006/0283637 | A1 | 12/2006 | Viel et al. |
| 2007/0215389 | A1 | 9/2007 | Da Silva et al. |
| 2007/0215390 | A1 | 9/2007 | Azar et al. |
| 2007/0284153 | A1 | 12/2007 | Richert et al. |
| 2008/0017421 | A1 | 1/2008 | Lockwood |
| 2008/0057145 | A1 | 3/2008 | Hall et al. |
| 2008/0073126 | A1 | 3/2008 | Shen et al. |
| 2008/0085407 | A1 | 4/2008 | Cooley et al. |
| 2008/0115421 | A1 | 5/2008 | Sani |
| 2008/0128951 | A1 | 6/2008 | Lockwood |
| 2008/0135306 | A1 | 6/2008 | Da Silva et al. |
| 2008/0142262 | A1 | 6/2008 | Drivdahl et al. |
| 2008/0142276 | A1 | 6/2008 | Griffo et al. |
| 2008/0149398 | A1 | 6/2008 | Azar |
| 2008/0185189 | A1 | 8/2008 | Griffo et al. |
| 2008/0202821 | A1 | 8/2008 | McClain et al. |
| 2008/0206576 | A1 | 8/2008 | Qian et al. |
| 2008/0223623 | A1 | 9/2008 | Keshavan et al. |
| 2008/0230280 | A1 | 9/2008 | Keshavan et al. |
| 2008/0282618 | A1 | 11/2008 | Lockwood |
| 2008/0302579 | A1 | 12/2008 | Keshavan et al. |
| 2009/0090563 | A1 | 4/2009 | Voronin et al. |
| 2009/0095532 | A1 | 4/2009 | Laird et al. |
| 2009/0107732 | A1 | 4/2009 | McClain et al. |
| 2009/0120008 | A1 | 5/2009 | Lockwood et al. |
| 2009/0133938 | A1 | 5/2009 | Hall |
| 2009/0152017 | A1 | 6/2009 | Shen et al. |
| 2009/0152018 | A1 | 6/2009 | Sani |
| 2009/0173015 | A1 | 7/2009 | Keshavan et al. |
| 2009/0173547 | A1 | 7/2009 | Voronin et al. |
| 2009/0273224 | A1 | 11/2009 | Hall |
| 2010/0012389 | A1 | 1/2010 | Zhang et al. |
| 2010/0062253 | A1 | 3/2010 | Egan et al. |
| 2010/0196717 | A1 | 8/2010 | Liversage et al. |
| 2010/0236836 | A1 | 9/2010 | Voronin |
| 2010/0243337 | A1 | 9/2010 | Scott |
| 2010/0281782 | A1 | 11/2010 | Keshavan et al. |
| 2010/0300767 | A1 | 12/2010 | Cariveau et al. |
| 2010/0320006 | A1 | 12/2010 | Fan et al. |
| 2011/0030283 | A1 | 2/2011 | Cariveau et al. |
| 2011/0031032 | A1 | 2/2011 | Mourik |
| 2011/0031033 | A1 | 2/2011 | Mourik |
| 2011/0031037 | A1 | 2/2011 | Bellin |
| 2011/0036643 | A1 | 2/2011 | Belnap |
| 2012/0222364 | A1 | 9/2012 | Lyons et al. |
| 2013/0074420 | A1 | 3/2013 | Zhang et al. |

FOREIGN PATENT DOCUMENTS

| | | | |
|---|---|---|---|
| EP | 0374424 | | 1/1995 |
| EP | 0487355 | B1 | 3/1995 |
| EP | 1006257 | B1 | 2/2004 |
| EP | 1330323 | B1 | 5/2006 |
| WO | 0234437 | | 5/2002 |
| WO | 2008076908 | A2 | 6/2008 |
| WO | 2010020962 | | 2/2010 |

OTHER PUBLICATIONS

International Search Report and Written Opinion dated Mar. 21, 2011 for related PCT application No. PCT/US2010/044698 filed Aug. 6, 2010.

International Search Report and Written Opinion dated Mar. 17, 2011 for related PCT application No. PCT/US2010/044657 filed Aug. 6, 2010.

"PCD Hammer Bit Inserts", Guilin Coller Engineered Diamond Technology (EDT) Co., Ltd., www.heavendiamonds.com.

International Search Report and Written Opinion of PCT Application No. PCT/US2010/044657 dated Mar. 17, 2011: pp. 1-8.

International Search Report and Written Opinion of PCT Application No. PCT/US2010/044698 dated Mar. 21, 2011: pp. 1-9.

International Search Report and Written Opinion of PCT Application No. PCT/US2010/044640 dated Mar. 23, 2011: pp. 1-8.

International Search Report and Written Opinion of PCT Application No. PCT/US2010/044664 dated Mar. 30, 2011: pp. 1-8.

Third Party Reference Submission of Australian Application No. 2010279358 dated Apr. 24, 2013: pp. 1-13.

Third Party Reference Submission of Australian Application No. 2010279280 dated Apr. 24, 2013: pp. 1-9.

Third Party Reference Submission of Australian Application No. 2010279295 dated Apr. 24, 2013: pp. 1-12.

International Search Report and Written Opinion of PCT Application No. PCT/US2010/044797 dated Mar. 29, 2011: pp. 1-10.

International Search Report and Written Opinion of PCT Application No. PCT/US2010/044731 dated Mar. 23, 2011: pp. 1-9.

Umrath et al., "Vacuum Physics," Fundamentals of Vacuum Technology, Leybold Vacuum, 2007: pp. 1, 3 and 14, <http://www.surface.mat.ethz.ch/education/courses/surfaces_interfaces_and_their_applications/leybold_fundamentals_of vacuum>.

FUNCTIONALLY GRADED POLYCRYSTALLINE DIAMOND INSERT

CROSS-REFERENCE TO RELATED APPLICATIONS

This application claims priority to U.S. Provisional Application No. 61/232,151, filed Aug. 7, 2009, which is hereby incorporated by reference in its entirety.

BACKGROUND OF THE INVENTION

1. Field of the Invention

This invention relates to rotary cone bits used for subterranean drilling and, more particularly, to inserts used with rotary cone bits that are specially engineered having a functionally graded polycrystalline diamond microstructure to provide improved elastic properties, mechanical properties and/or thermal properties when compared to conventional polycrystalline diamond inserts.

2. Background Art

Polycrystalline diamond (PCD) materials known in the art are formed from diamond grains or crystals and a ductile metal binder and are synthesized by high temperature/high pressure processes. Such material is well known for its mechanical properties of wear resistance, making it a popular material choice for use in such industrial applications as cutting tools for machining, and subterranean mining and drilling where such mechanical properties are highly desired. For example, conventional PCD can be provided in the form of surface coatings on, e.g., inserts used with cutting and drilling tools to impart improved wear resistance thereto.

Traditionally, PCD inserts used in such applications are formed by coating a carbide substrate with a layer of PCD. Such inserts comprise a substrate, a surface layer, and often a transition layer to improve the bonding between the exposed layer and the substrate. The substrate is typically a carbide material, e.g., cemented carbide, tungsten carbide (WC) cemented with cobalt (WC—Co).

The PCD layer conventionally includes metal binder up to about 30 percent by weight. The metal binder facilitates diamond intercrystalline bonding, and bonding of diamond layer to the substrate. Metals employed as the binder are often selected from cobalt, iron, or nickel and/or mixtures or alloys thereof and can include metals such as manganese, tantalum, chromium and/or mixtures or alloys thereof. However, while higher metal binder content typically increases the toughness of the resulting PCD material, higher metal content also decreases the PCD material hardness and wear resistance, thus limiting the flexibility of being able to provide PCD coatings having desired levels of hardness, wear resistance and toughness. Additionally, when variables are selected to increase the hardness or wear resistance of the PCD material, typically brittleness also increases, thereby reducing the toughness of the PCD material.

Conventional PCD inserts may include one or more transition layers between the PCD layer and the substrate. Such transition layers include refractory particles such as carbides in addition to the diamond and metal binder to change materials properties through the layers. However, carbide content manipulation does not always promote the best transition between adjacent PCD insert layers, permitting discrete interfaces to exist between the layers which can promote unwanted stress concentrations. The existence of these discrete interfaces, and the resulting stress concentrations produced therefrom, can cause premature failure of the PCD insert by delamination along the layer-to-layer interfaces.

It is, therefore, desired that a PCD insert be constructed in a manner that provides a desired balance of hardness, wear or abrasion resistance, and toughness while also reducing and/or eliminating the existence of residual stress concentrations within the construction to thereby provide an extended service life. It is also desired that the PCD insert be constructed in a manner that provides an improved degree of thermal stability during operation when compared to conventional PCD inserts, thereby effectively extending service life.

SUMMARY OF THE INVENTION

Functionally-Graded PCD inserts of this invention comprise a polycrystalline diamond body having a material microstructure of bonded together diamond grains and a binder phase of metal binder dispersed among the diamond grains. The diamond body comprises two or more functionally-graded polycrystalline diamond regions or layers moving from an outer surface of the body towards a metallic substrate. Generally speaking, the amount of diamond in the body is engineered to decrease moving from the outer surface to the substrate. In an example embodiment, the decrease in diamond content is provided by increasing metal binder content. In an example embodiment, the metal content within each body region or layer changes in a gradient manner. In an example embodiment, the body first region adjacent the outer surface comprises about 5 to 20 percent by weight metal binder, and the body region remote from the surface comprises about 15 to 40 percent by weight metal binder.

The construction further comprises one or more polycrystalline diamond transition regions that are interposed between the diamond body and the substrate. Generally, the transition region comprises polycrystalline diamond, binder metal, and a carbide material or other material that is present in the substrate. In an example embodiment, the transition region comprises a metal binder content that is less than that present in the body second region. In an example embodiment, the transition region comprises greater than 50 percent by weight carbide. When provided in the form of two or more regions or layers, the transition layer adjacent the diamond body includes a metal binder content that is greater than, and a carbide content that is less than, the transition layer adjacent the substrate.

PCD inserts constructed in this manner provide a desired combination/balance of wear resistance and toughness using a reduced diamond body outer layer thickness. Further, the gradient change of metal content and diamond content within the diamond body operates to reduce or eliminate the existence of residual stress concentrations within the construction to thereby provide an extended service life. Further still, the combined construction of such FG-PCD layers with the transition layer or layers operates to provide an improved degree of thermal stability during operation when compared to conventional PCD inserts, thereby effectively extending service life.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
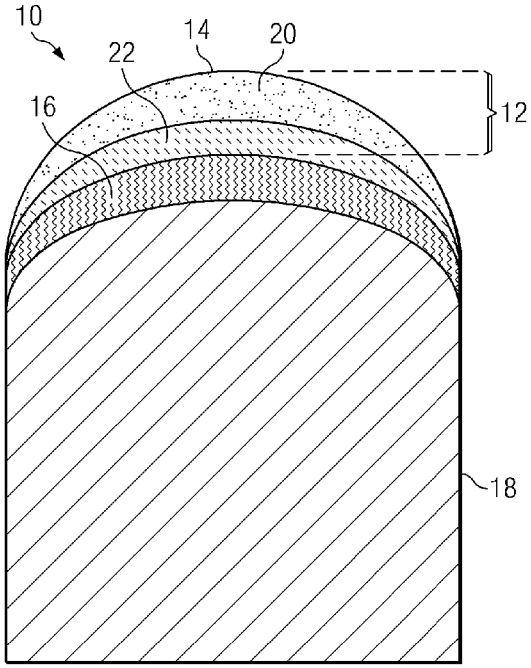
FIG. 1 is a cross-sectional side view of an example embodiment PCD insert.

As used in this specification, the term polycrystalline diamond, along with its abbreviation "PCD," refers to the material produced by subjecting individual diamond crystals or grains sufficiently high pressure and high temperature conditions in the presence of a metal solvent catalyst material or metal binder material that intercrystalline bonding occurs between adjacent diamond crystals. A characteristic of PCD is that the diamond crystals bonded to each other to form a rigid body having a material microstructure comprising a matrix phase of intercrystalline bonded diamond with the metal binder dispersed within interstitial regions within the matrix phase.

PCD inserts of this invention generally comprise a functionally-graded PCD (FG-PCD) material that can be provided as two or more layers comprising a decreasing diamond content moving away from an outer or working surface of the insert towards a substrate. The decreasing diamond content within the FG-PCD material is achieved by increasing the amount of the metal binder material therein. Unlike conventional PCD inserts, the reduction in diamond content within the construction is not achieved through the use of additives like refractory materials or the like, e.g., by carbide addition. Accordingly, FG-PCD materials described herein can be referred to as being "substantially free" of added carbide. As used herein, the term "substantially free" is understood to mean that no free carbide is intentionally added to the diamond grains used to form the FG-PCD material. Any carbide that may be unintentionally be added by result of processing or the like, e.g., during attriator/ball milling, is considered to be residual carbide. The existence of such residual carbide is not considered free carbide, so that FG-PCD materials comprising such residual carbide are understood to be "substantially free" of carbide within the scope of this invention.

Further, to achieve a both a reduced degree of residual stress and an improved degree of thermal stability within the PCD insert construction, the change in metal binder content within the FG-PCD material is engineered to be continuous.

In an example embodiment, the region of the PCD insert FG-PCD material positioned adjacent the insert outer or working surface is relatively lean in metal binder, while the region of the FG-PCD material positioned adjacent the substrate interface is relatively richer in metal binder. In an example embodiment, the region of the FG-PCD material adjacent the outer surface may comprise in the range of from about 5 to 20 percent by weight metal binder. It is desired that such region comprise greater than about 5 percent by weight, and preferably greater than about 8 percent by weight, of the metal binder to provide a desired high level of wear resistance while still retaining a suitable degree of fracture toughness. As described below, the bulk fracture toughness for the insert is provided by the core or inner layer of FG-PCD material that comprises a higher proportion of the metal binder. Because the underlying layer of FG-PCD material includes a higher proportion of the metal binder, such layer operates to resist the propagation of any cracks through the PCD body from any cracks than may form along the outer FG-PCD layer, thereby increasing the fracture toughness of the construction.

Having greater than about 20 percent by weight of the metal binder in this outer region is not desired because such a material would exhibit a relatively high rate of wear that would not be suitable for the desired high wear applications without being present in a very thick material layer to preserve service life expectancy. A construction comprising such a thick outer material layer is not desired for purposes of reducing material and/or manufacturing costs. It is to be understood that the exact amount of the metal binder present in this outer region can vary within this range depending on such factors as the size of the diamond grains used to form the FG-PCD material, the type of the metal binder that is selected, and/or the particular end use application.

In a preferred embodiment, the FG-PCD material region adjacent the PCD insert outer or working surface may comprise in the range of from 12 to 18 percent by weight metal binder. In a most preferred embodiment, where the metal binder material is cobalt, the FG-PCD material region adjacent the PCD insert outer or working surface comprises approximately 13 to 15 percent by weight metal binder. The amount of the metal binder in this particular FG-PCD material region is selected to provide a desired degree of fracture toughness to the construction as noted above while also minimizing differences in thermal characteristics between the adjacent FG-PCD layers.

In an example embodiment, the region of the FG-PCD material adjacent the substrate may comprise in the range of from about 15 to 40 percent by weight metal binder, and preferably comprises in the range of from about 18 to 35 percent by weight metal binder. In a most preferred embodiment, when the metal binder is Co, such FG-PCD material comprises in the range of from about 20 to 30 percent by weight metal binder. It is desired that such FG-PCD region comprise greater than about 9 percent by weight of the metal binder because to increase the favorable compressive residual stress in the diamond crystals, resulting in making such FD-PCD region tougher. Having greater than about 30 percent by weight of the metal binder in this region is not desired because fracture toughness reaches a maximum at 30 percent and then declines with additional amounts of the metal binder. Also, at metal binder levels above 30 percent, the wear resistance for this layer decreases below acceptable levels for use in desired wear applications. It is to be understood that the exact amount of the metal binder present in this region can vary within this range depending on such factors as the size of the diamond grains used to form the FG-PCD material, the type of the metal binder that is selected, and/or the particular end use application.

The metal binder content in each of the FG-PCD material regions can be measured using conventional techniques. In an example embodiment, the metal binder content can be measured using energy-dispersive spectrometry or the like. A feature of the FG-PCD material is that the metal binder content within the FG-PCD material and each such region changes therein in a gradient manner, which provides for a smooth transition of both elastic/mechanical properties as well as thermal properties such as the coefficient of thermal expansion, thereby reducing residual stress within the sintered part.

In an example embodiment, the diamond grains used to form the PCD material of the PCD insert can be synthetic or natural and can have an average particle size that range from submicrometer in size to 50 micrometers. If desired, the diamond grains can have a monomodal or multimodal size distribution. In the event that a multimodal size distribution of diamond powder is desired, the differently-sized diamond grains can be mixed together by appropriate method and combined with the desired metal binder. Alternatively, in the event that it is desired to use differently-sized diamond grains to form different PCD layers or regions within the PCD insert, then the differently sized diamond grains are processed separately for forming the different PCD layers or regions.

The desired diamond powder and the metal binder are combined in the desired proportion to form the PCD material used to make the PCD insert. The metal binder can be selected from those materials used to form conventional PCD, such as Group VIII materials taken from the Periodic Table like Co, Ni, Fe and combinations thereof. Alternatively, instead of being provided in powder form, the PCD and metal binder materials useful for making PCD inserts can be provided in green state form, e.g., in the form of tape or the like.

FIG. 1 illustrates an example PCD insert 10 comprising a FG-PCD material 12 that extends from an outer or working surface 14 of the insert to a transition PCD layer 16 that is interposed between the FG-PCD material 12 and a substrate 18. As illustrated in this example, the FG-PCD material and transition PCD layer each have a complementary radius of curvature as called for by the particular insert application.

In this particular example, the FG-PCD material 12 is provided in two layers or regions; namely, a first layer 20 that extends inwardly into the construction from the outer or working surface 14, and a second layer 22 that extends inwardly from the first layer 20 to an interface with the transition PCD layer 16. The FG-PCD first layer or region 20 has a relatively lean metal binder content within the range noted above, and in a particular example comprises approximately 15 percent by weight cobalt, and has a thickness in the range of from about 125 to 600 microns, and more preferably in the range of from about 150 to 300 microns. In a preferred embodiment, the outer layer thickness is approximately 250 microns.

In a preferred embodiment, the metal binder content in the first layer decreases in a gradient manner moving from the insert outer surface 14 to the second layer 22. In such example embodiment, the metal binder content at the outer surface is approximately about 13 percent by weight, and the metal binder content at the interface with the second layer is approximately 15 percent by weight. A feature of the FG-PCD first layer or region is that the decrease in diamond content therein is achieved by increasing the metal binder content rather than by adding other materials such as refractory materials into the composition.

The FG-PCD second layer or second region 22 has a relatively rich metal binder content within the range noted above for the FG-PCD region adjacent the substrate, and in a particular example is approximately 20 percent by weight cobalt, and has a thickness in the range of from about 125 to 1,250 microns, and more preferably in the range of from about 400 to 750 microns. In a preferred embodiment, the metal binder content in the second layer 22 decreases in a gradient manner moving from the interface with the first layer 20 to the transition layer 16. In such example embodiment, the metal binder content at the first layer interface is in the range of from about 15 to 17 percent by weight, and the metal binder content at the interface with the underlying transition layer is in the range of from about 18 to 20 percent by weight.

As noted above with respect to the FG-PCD first layer or region, the decrease in diamond content within the FG-PCD second layer or region can also be achieved by increasing the metal binder content rather than by adding other materials such as refractory materials into the composition. Alternatively, if desired some additive can be used in addition to increasing the metal binder content to achieve the desired decrease in diamond content.

A feature of the example PCD insert construction illustrated in FIG. 1 is that the FG-PCD material 12 provides for a thicker top layer of PCD, provided primarily by the FG-PCD second layer, while also providing a desired degree of wear resistance using a relatively thinner FG-PCD layer, and additionally reducing the necessary thickness of the transition layer. The use of a relatively thicker top layer of PCD is desired as this layer is the one that that provides the desired combination of wear resistance and toughness for engaging the formation being drilled, thereby increasing the effective service life of the PCD insert. As noted above, because it is relatively difficult to produce a thick FG-PCD first layer, the FG-PCD second layer is made thicker to contribute the desired degree of toughness. In this embodiment, a transition layer is provided between the FG-PCD layers and the substrate, and is provided having a thickness at least as thick as the FG-PCD first layer 20, or thicker or in proportion to the FG-PCD second layer 22.

Transition layers as used to form composite construction of the invention comprise PCD, and one or more other material that has physical and/or thermal properties that are closely matched to the substrate. In example embodiments, such other material can be one or more constituent also present in the substrate. In this particular embodiment, the transition layer 16 comprises a composite construction of PCD and one or more material constituent from the substrate 18. Where the substrate comprises a cermet material, such as WC—Co, the transition layer 16 comprises a matrix phase of bonded-together diamond grains, and both a metal binder material and WC dispersed within interstitial regions within the matrix. The diamond grains used to form the PCD in the transition layer can be the same or different from those used to form the FG-PCD material.

The metal binder content within the transition layer will vary depending on the number of FG-PCD layers that are provided, the number of transition layers used, and the material make up of the substrate. Generally, the transition layer can comprise in the range of from about 2 to 15 percent by weight metal binder, and generally the transition layer comprises an amount of the metal binder that is less than that of the adjacent FG-PCD layer. In this particular example embodiment where the metal binder is Co, the transition layer 16 comprises in the range of from about 3 to 6 percent by weight of the metal binder. The substrate constituent content within the transition layer can vary depending on the same factors noted above. Generally, the transition layer can comprises in the range of from about 50 to 90 percent by weight of the substrate constituent. In this particular example embodiment where the substrate constituent is WC, the transition layer 16 comprises in the range of from about 55 to 65 percent by weight of the substrate constituent.

Figure 2:
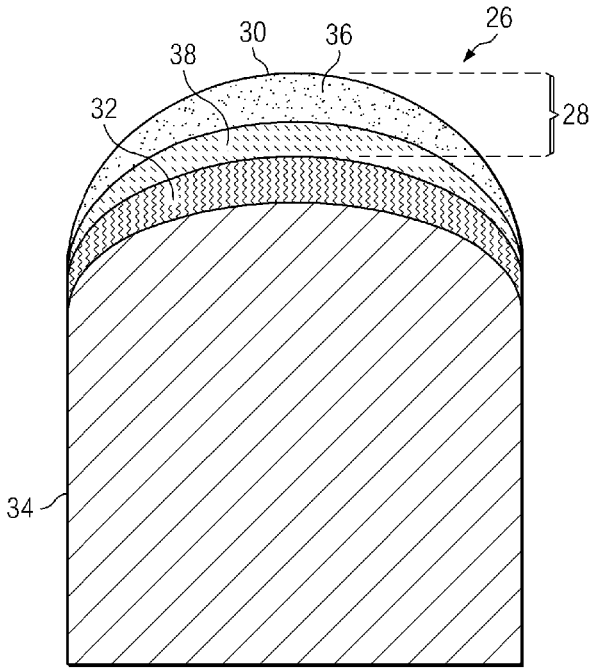
FIG. 2 is a cross-sectional side view of another example embodiment PCD insert.

FIG. 2 illustrates an example PCD insert 26 comprising a FG-PCD material 28 that extends from an outer or working surface 30 of the insert to a transition PCD layer 32 interposed between the FG-PCD material and a substrate 34. As illustrated in this example, the FG-PCD material and transition PCD layer each have a complementary radius of curvature as called for by the particular insert application. In this particular example, the FG-PCD material 28 is provided in two layers;

namely, a first layer 36 that extends inwardly into the construction from the outer or working surface 30, and a second layer 38 that extends inwardly from the first layer 36 to an interface with the transition PCD layer 32.

The FG-PCD first layer or region 36 has a relatively lean metal binder content within the range noted above, and in a particular example of approximately 15 percent by weight cobalt, and has a thickness in the range of from about 125 to 600 microns, and more preferably in the range of from about 250 to 400 microns. In a preferred embodiment, the metal binder content in the first layer decreases in a gradient manner moving from the insert outer surface 30 to the second layer 38. In such example embodiment, the metal binder content at the outer surface is in the range of from about 12 to 15 percent by weight, and the metal binder content at the interface with the second layer is in the range of from about 15 to 17 percent by weight. A feature of the FG-PCD first layer or region is that the decrease in diamond content therein is achieved by increasing the metal binder content rather than by adding other materials such as refractory materials into the composition.

The FG-PCD second layer or second region 38 has a relatively rich metal binder content within the range noted above, and in a particular example of approximately 20 percent by weight cobalt, and has a thickness in the range similar to layer 36. In a preferred embodiment, the metal binder content in the second layer decreases in a gradient manner moving from the interface with the first layer 36 to the transition layer 32. In such example embodiment, the metal binder content at the first layer interface is in the range of from about 10 to 20 percent by weight, and the metal binder content at the interface with the transition layer is in the range of from about 10 to 30 percent by weight.

A feature of this example embodiment is that the FG-PCD second layer 38 includes a carbide material, e.g., WC or the like. In an example embodiment the amount of such added carbide material is less than about 15 percent by weight. An advantage of including an additive such as a carbide material in the FG-PCD second layer is that it enables formation of a material layer having a stiffness and hardness that is close to that of the FG-PCD first layer, thereby acting to further smoothen the transition of elastic/mechanical properties within the FG-PCD material. The FG-PCD second layer comprises a higher level of metal binder than the FG-PCD first layer, and in this embodiment approximately 20 percent by weight.

The transition layer 34 comprises a composite construction of PCD and one or more material constituent from the substrate 34 as described above for the example embodiment illustrated in FIG. 1.

Figure 3:
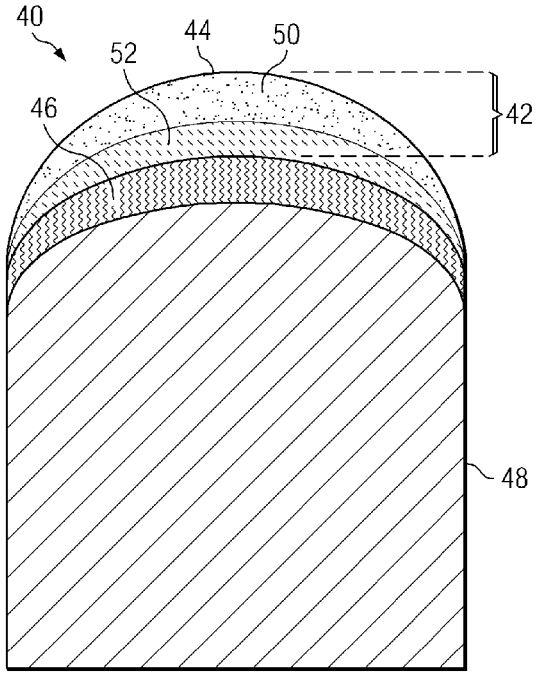
FIG. 3 is a cross-section side view of another example embodiment PCD insert.

FIG. 3 illustrates an example PCD insert 40 comprising a FG-PCD material 42 that extends from an outer or working surface 44 of the insert to a transition PCD layer 46 interposed between the FG-PCD material and a substrate 48. As illustrated in this example, the FG-PCD material and transition PCD layer each have a complementary radius of curvature as called for by the particular insert application. In this particular example, the FG-PCD material 42 is provided in two layers; namely, a first layer 50 that extends inwardly into the construction from the outer or working surface 44, and a second layer 52 that extends inwardly from the first layer 50 to an interface with the transition PCD layer 46.

The FG-PCD first layer or region 50 has a relatively lean metal binder content within the range noted above, and in a particular example of approximately 20 percent by weight cobalt, and has a thickness within the range noted above for the examples of FIGS. 1 and 2. In a preferred embodiment, the metal binder content in the first layer decreases in a gradient manner moving from the insert outer surface 44 to the second layer 52. A feature of the FG-PCD first layer or region is that the decrease in diamond content therein is achieved by increasing the metal binder content rather than by adding other materials such as refractory materials into the composition.

The FG-PCD second layer or second region 52 has a relatively rich metal binder content within the range noted above, and in a particular example of approximately 30 percent by weight cobalt, and has a thickness within the range noted above for the examples illustrated in FIGS. 1 and 2. In a preferred embodiment, the metal binder content in the second layer decreases in a gradient manner moving from the interface with the first layer 50 to the transition layer 46. A feature of this example embodiment is that the FG-PCD second layer 52 has a relatively higher content of metal binder, e.g., that is closer to that of substrate. Composing the FG-PCD second layer in this manner allows for the creation of a relatively thick FG-PCD material layer to provide an enhanced degree of toughness and extended wear to meet the needs of a particular application, thereby extending PCD insert service life.

The transition layer 46 comprises a composite construction of PCD and one or more material constituent from the substrate 48 as described above for the example embodiment illustrated in FIG. 1.

Figure 4:
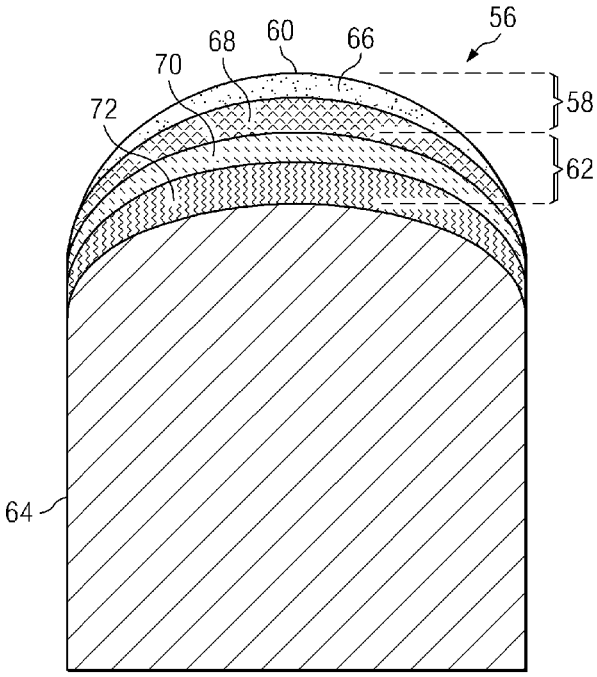
FIG. 4 is a cross-section side view of another example embodiment PCD insert.

FIG. 4 illustrates an example PCD insert 56 comprising a FG-PCD material 58 that extends from an outer or working surface 60 of the insert to a transition PCD material 62 interposed between the FG-PCD material and a substrate 64. As illustrated in this example, the FG-PCD material and transition PCD material each have a complementary radius of curvature as called for by the particular insert application. In this particular example, the FG-PCD material 58 is provided in two layers; namely, a first layer 66 that extends inwardly into the construction from the outer or working surface 60, and a second layer 68 that extends inwardly from the first layer 66 to an interface with the transition PCD material 62.

The FG-PCD first layer or region 68 has a relatively lean metal binder content within the range noted above, and in a particular example of approximately 20 percent by weight cobalt, and has a thickness in the range as noted above for the examples illustrated in FIGS. 1 and 2. In a preferred embodiment, the metal binder content in the first layer decreases in a gradient manner moving from the insert outer surface 60 to the second layer 68. A feature of the FG-PCD first layer or region is that the decrease in diamond content therein is achieved by increasing the metal binder content rather than by adding other materials such as refractory materials into the composition.

The FG-PCD second layer or second region 68 has a relatively rich metal binder content within the range noted above, and in a particular example of approximately 30 percent by weight cobalt, and has a thickness as noted above for the examples illustrated in FIGS. 1 and 2. In a preferred embodiment, the metal binder content in the second layer decreases in a gradient manner moving from the interface with the first layer 66 to the transition material 62.

A feature of this example embodiment is that the FG-PCD second layer 68 has a relatively higher content of metal binder, e.g., that is closer to that of the substrate. Composing the FG-PCD second layer in this manner allows for the creation of a relatively thick FG-PCD material layer to provide an enhanced degree of toughness and extended wear to meet the needs of a particular application, thereby extending PCD insert service life.

The transition material 62 in this particular embodiment comprises a first transition layer 70, and a second transition layer 72, wherein the first transition layer is interposed between the second FG-PCD layer 68 and the second transition layer, and the second transition layer is interposed between the first transition layer and the substrate 64. The first transition layer 70 comprises PCD and a mixture of binder metal and constituent from the substrate 64. When the substrate is a cermet material such as WC—Co, the first and second transition layers include WC. In an example embodiment, the fist transition layer 70 comprises a lesser amount of WC than does the second transition layer 72. The first transition layer 70 comprises in the range of from about 60 to 75 percent by weight WC, and the second transition layer 72 comprises in the range of from about 80 to 90 percent by weight WC. For this embodiment, the first transition layer comprises in the range of from about 5 to 15 percent by weight metal binder, and the second transition layer 72 comprises in the range of from about 2 to 10 percent by weight metal binder.

The use of the two different transition layers in this particular embodiment is desired for the purpose of further enhancing the gradient or smooth transition of elastic/mechanical and/or thermal properties through the insert construction from the FG-PCD layers to the substrate.

There may exist embodiments of the construction comprising two or more transition layers where the metal binder content increases moving from the FG-PCD layer to the substrate. This can be accomplished by diluting the presence of the metal binder by adding more diamond and/or by adding more carbide between the layers. For example, while the metal binder content within a first transition layer adjacent the FG-PCD layer is less than that in the FG-PCD layer, such metal binder content may also be less than a second transition layer positioned adjacent the first transition layer.

While the examples disclosed above and illustrated in the figures depict a PCD insert comprising a FG-PCD material made up of two different layers, it is to be understood that the FG-PCD material can be formed from more than two different layers as desired for the purpose of controlling the transition of elastic/mechanical and/or thermal properties within the PCD insert. The same is true for the transition layer, while this has been described and illustrated as being provided in the form of one or two layers, it is to be understood that a transition layer comprising more than two layers can be used within the scope of this invention. The ability of being able to provide the FG-PCD material and/or transition material in different layers operates to both optimize material properties within the construction while at the same time easing drastic changes in modulus and thermal expansion discrepancy that can exist across interfaces, which changes could otherwise create high stress concentrations.

The following example PCD composite constructions are provided in the table below for the purpose of further illustrating the different variations of constructions and/or materials used to make the same of this invention. With reference to this table, the terms FG-PCD-1, FG-PCD-2 and FG-PCD-3 are used to refer to the FG-PCD first, second and third layers in the construction moving from the outer surface inwardly, respectively. The terms TL-1 and TL-2 are used to refer to the transition layers moving from the FG-PCD material to the substrate, respectively:

| Example 1 - (Volume %) | | | | Example 1 - (Weight %) | | | |
|---|---|---|---|---|---|---|---|
| | Diamond | Cobalt | WC | (in weight %) | Diamond | Cobalt | WC |
| FG-PCD-1 | 93 | 6 | 0 | FG-PCD-1 | 85 | 13 | 0 |
| FG-PCD-2 | 91 | 9 | 0 | FG-PCD-2 | 80 | 20 | 0 |
| TL-1 | 54 | 5 | 40 | TL-1 | 23 | 6 | 71 |
| TL-2 | 36 | 4 | 60 | TL-2 | 12 | 3 | 85 |
| Example 2 - (Volume %) | | | | Example 2 - (Weight %) | | | |
| (in volume %) | Diamond | Cobalt | WC | (in weight %) | Diamond | Cobalt | WC |
| FG-PCD-1 | 93 | 6 | 0 | FG-PCD-1 | 85 | 13 | 0 |
| FG-PCD-2 | 86 | 14 | 0 | FG-PCD-2 | 70 | 30 | 0 |
| TL-1 | 54 | 5 | 40 | TL-1 | 23 | 6 | 71 |
| TL-2 | 36 | 4 | 60 | TL-2 | 12 | 3 | 85 |
| Example 3 - (Volume %) | | | | Example 3 - (Weight %) | | | |
| | Diamond | Cobalt | WC | | Diamond | Cobalt | WC |
| FG-PCD-1 | 91 | 9 | 0 | FG-PCD-1 | 80 | 20 | 0 |
| FG-PCD-2 | 86 | 14 | 0 | FG-PCD-2 | 70 | 30 | 0 |
| TL-1 | 54 | 5 | 40 | TL-1 | 23 | 6 | 71 |
| TL-2 | 36 | 4 | 60 | TL-2 | 12 | 3 | 85 |
| Example 4 - (Volume %) | | | | Example 4 - (Weight %) | | | |
| | Diamond | Cobalt | WC | | Diamond | Cobalt | WC |
| FG-PCD-1 | 93 | 6 | 0 | FG-PCD-1 | 85 | 13 | 0 |
| FG-PCD-2 | 91 | 9 | 0 | FG-PCD-2 | 80 | 20 | 0 |
| FG-PCD-3 | 86 | 14 | 0 | FG-PCD-3 | 70 | 30 | 0 |
| Example 5 - (Volume %) | | | | Example 5 - (Weight %) | | | |
| | Diamond | Cobalt | WC | | Diamond | Cobalt | WC |
| FG-PCD-1 | 93 | 6 | 0 | FG-PCD-1 | 85 | 13 | 0 |
| FG-PCD-2 | 91 | 9 | 0 | FG-PCD-2 | 80 | 20 | 0 |

-continued

| | | | | | | | |
|---|---|---|---|---|---|---|---|
| FG-PCD-3 | 86 | 14 | 0 | FG-PCD-3 | 70 | 30 | 0 |
| TL | 36 | 4 | 60 | TL | 36 | 4 | 60 |

| Example 6 - (Volume %) | | | | Example 6 - (Weight %) | | | |
|---|---|---|---|---|---|---|---|
| | Diamond | Cobalt | WC | | Diamond | Cobalt | WC |
| FG-PCD-1 | 93 | 6 | 0 | FG-PCD-1 | 85 | 13 | 0 |
| FG-PCD-2 | 91 | 9 | 0 | FG-PCD-2 | 80 | 20 | 0 |
| FG-PCD-3 | 86 | 14 | 0 | FG-PCD-3 | 70 | 30 | 0 |
| TL | 36 | 4 | 60 | TL | 36 | 4 | 60 |

| Example 7 - (Volume %) | | | | Example 7 - (Weight %) | | | |
|---|---|---|---|---|---|---|---|
| | Diamond | Cobalt | WC | | Diamond | Cobalt | WC |
| FG-PCD-1 | 93 | 6 | 0 | FG-PCD-1 | 85 | 13 | 0 |
| FG-PCD-2 | 91 | 9 | 0 | FG-PCD-2 | 80 | 20 | 0 |
| TL-1 | 50 | 9 | 40 | TL-1 | 19 | 10 | 71 |
| TL-2 | 32 | 7 | 60 | TL-2 | 16 | 7 | 85 |

| Example 8 - (Volume %) | | | | Example 8 - (Weight %) | | | |
|---|---|---|---|---|---|---|---|
| | Diamond | Cobalt | WC | | Diamond | Cobalt | WC |
| FG-PCD-1 | 93 | 6 | 0 | FG-PCD-1 | 85 | 13 | 0 |
| FG-PCD-2 | 81 | 19 | 0 | FG-PCD-2 | 70 | 30 | 0 |
| TL-1 | 50 | 9 | 40 | TL-1 | 19 | 10 | 71 |
| TL-2 | 32 | 7 | 60 | TL-2 | 16 | 7 | 85 |

| Example 9 - (Volume %) | | | | Example 9 - (Weight %) | | | |
|---|---|---|---|---|---|---|---|
| | Diamond | Cobalt | WC | | Diamond | Cobalt | WC |
| FG-PCD-1 | 93 | 6 | 0 | FG-PCD-1 | 85 | 13 | 0 |
| TL-1 | 54 | 5 | 40 | TL-1 | 23 | 6 | 71 |
| TL-2 | 50 | 9 | 40 | TL-2 | 19 | 10 | 71 |
| TL-3 | 32 | 7 | 60 | TL-3 | 16 | 7 | 85 |

While the geometry of the PCD inserts described above and illustrated in FIGS. 1 to 4 have been shown as having a curved outer surface, curved inside interfaces, and a curved substrate interface, it is to be understood that PCD inserts of this invention can be configured having outer and interior geometries that are flat or that have another shaped non-planer configuration, depending on the particular end-use application.

The ability to provide the FG-PCD material and/or transition material in different layers, and the resultant precise control over unwanted residual stress within the construction, allows for the creation of a relatively thicker working layer thickness, thereby operating to improve the effective service life of the PCD insert. Through the use of the different layers having different metal binder content the sintering behavior of each lay can be manipulated to control shrinkage and material properties.

Figure 5:
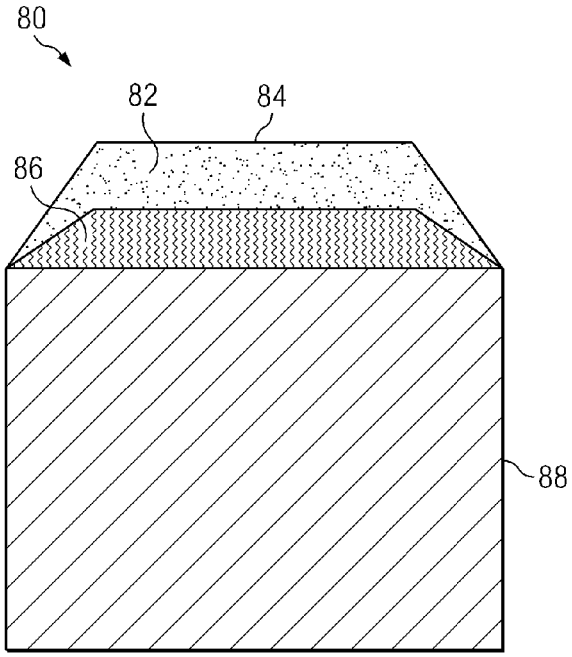
FIG. 5 is a cross-section side view of another example embodiment PCD insert.

FIG. 5 illustrates an example PCD insert 80 comprising a first FG-PCD layer or region 82 that extends from an outer or working surface 84 of the insert to a second FG-PCD layer or region 86 that is interposed between the first FG-PCD layer and a substrate 88. As illustrated in this example, the FG-PCD layers 82 and 86 each have a generally planar or flat top surface with beveled side surfaces as called for by the particular insert application. In this particular embodiment, the PCD insert 80 is configured for use as a heel row insert in a rotary cone bit used for drilling subterranean formations.

The FG-PCD first layer or region 82 has a relatively lean metal binder content within the range noted above, and in a particular example of approximately 10 percent by weight cobalt, and has a thickness in the range noted above for the examples illustrated in FIGS. 1 and 2. In a preferred embodiment, the metal binder content in the first layer decreases in a gradient manner moving from the insert outer surface 84 to the second layer 86. A feature of the FG-PCD first layer or region is that the decrease in diamond content therein is achieved by increasing the metal binder content rather than by adding other materials such as refractory materials into the composition.

The FG-PCD second layer or second region 86 has a relatively rich metal binder content within the range noted above, and in a particular example of approximately 15 percent cobalt, and has a thickness in the range noted above for the examples illustrated in FIGS. 1 and 2. In a preferred embodiment, the metal binder content in the second layer decreases in a gradient manner moving from the interface with the first layer 66 to the substrate 88

A feature of this example embodiment is that the PCD insert have two FG-PCD layers and does not have any additional PCD transition layer, e.g., a separate layer comprising WC or the like from the substrate. An additional feature of this particular example embodiment is that the two FG-PCD layers are constructed having a greater overall thickness while at the same time providing a desired high level of wear resistance and toughness.

Figure 6:
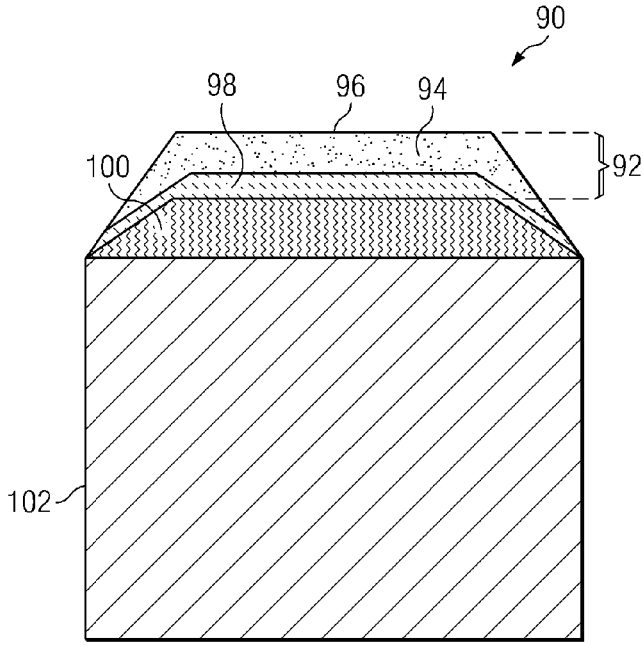
FIG. 6 is a cross-section side view of another example embodiment PCD insert.

FIG. 6 illustrates an example PCD insert 90 comprising a FG-PCD material 92 that includes a first FG-PCD layer or region 94 that extends from an outer or working surface 96 of the insert to a second FG-PCD layer or region 98 that is interposed between the first FG-PCD layer and a transition material 100. As illustrated in this example, the FG-PCD layers 94 and 98 each have a generally planar or flat top surface with beveled side surfaces as called for by the particular insert application. In this particular embodiment, the PCD insert 90 is configured for use as a heel row insert in a rotary cone bit used for drilling subterranean formations.

The FG-PCD first layer or region 94 has a relatively lean metal binder content within the range noted above, and in a particular example of about 10 to 15 percent by weight cobalt, and has a thickness in the range noted above for the examples illustrated in FIGS. 1 and 2. In a preferred embodiment, the metal binder content in the first layer decreases in a gradient manner moving from the insert outer surface 96 to the second layer 98. A feature of the FG-PCD first layer or region is that the decrease in diamond content therein is achieved by increasing the metal binder content rather than by adding other materials such as refractory materials into the composition.

The FG-PCD second layer or second region 98 has a relatively rich metal binder content within the range noted above, and in a particular example of about 12 to 20 percent by weight cobalt, and has a thickness in the range noted above for the examples illustrated in FIG. 1 and. In a preferred embodiment, the metal binder content in the second layer decreases in a gradient manner moving from the interface with the first layer 94 to the transition material 100.

The transition material 100 in this particular embodiment comprises a single layer of material comprising PCD mixed with a binder metal, e.g., Co, and a further additive which can be a constituent in the substrate. In an example embodiment, the additive can be a carbide material such as WC. In an example embodiment, the transition material 100 comprises approximately 20 percent by weight metal binder, e.g., Co, and comprises at least about 10 percent by weight additive, e.g., WC. The presence of both the metal binder and the additive in the transition material of this particular example aids in further enhancing the gradient or smooth transition of elastic/mechanical and/or thermal properties through the insert construction.

A feature of this PCD insert embodiment, provided in the form of a heel row insert comprising two FG-PCD layers and a further transition material is that is that is provides a relatively thicker working diamond layer while also providing an enhanced transition of elastic/mechanical and/or thermal properties within the PCD insert to minimize residual stress, thereby increasing effective service life.

PCD inserts constructed according to principles of this invention can be used in a number of different applications, such as tools for machining, cutting, mining and construction applications, where mechanical properties of wear resistance, abrasion resistance, fracture toughness and impact resistance are highly desired. PCD inserts of this invention can be used to form wear and cutting components in such tools as roller cone bits, percussion or hammer bits, drag bits, and a number of different cutting and machine tools.

Figure 7:
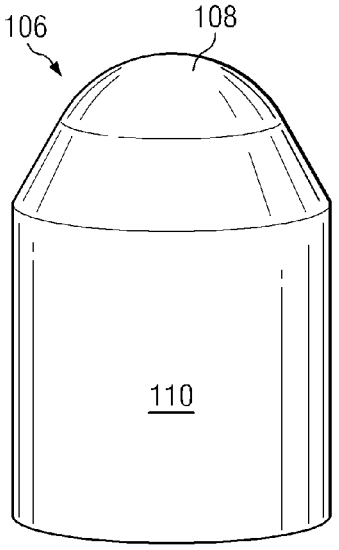
FIG. 7 is a schematic perspective side view of an examples PCD insert.

FIG. 7, for example, illustrates a mining or drill bit PCD insert 106 that is constructed in the manner described and/or illustrated above comprising a diamond body 108 formed from the FG-PCD material and transition materials noted above, that is joined to a substrate 110. While the PCD insert illustrated in FIG. 7 has a particular configuration, it is to be understood that PCD inserts constructed according to principals of this invention can be configured differently as called for by the particular end-use application and that such differently configured PCD inserts are within the scope of this invention.

Figure 8:
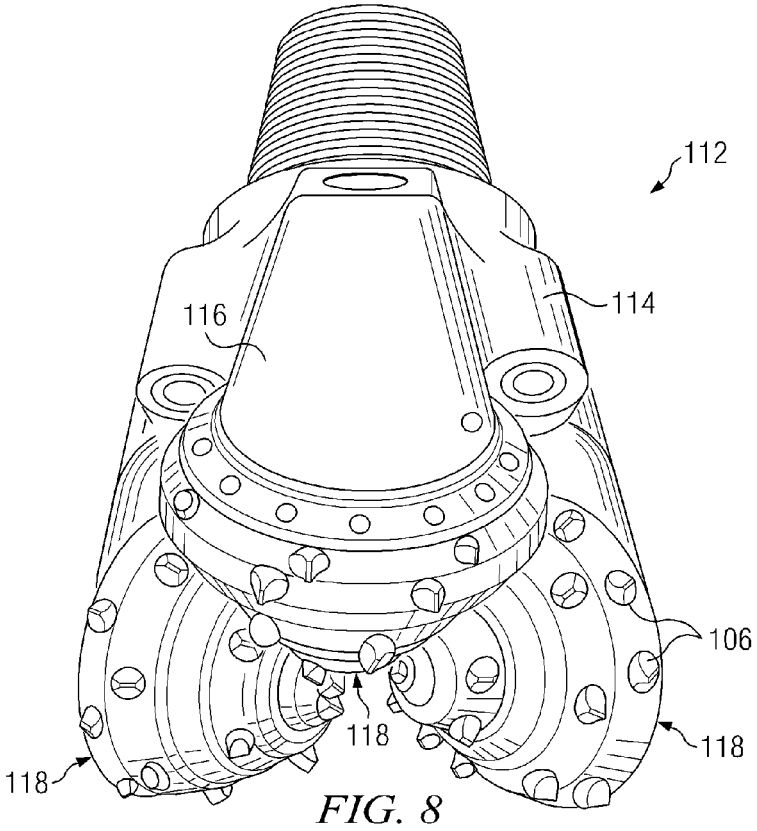
FIG. 8 is a perspective side view of a roller cone drill bit comprising a number of the PCD inserts of FIG. 7.

Referring to FIG. 8, such a PCD insert 106 can be used with a roller cone drill bit 112 comprising a body 114 having three legs 116, and a cutter cone 118 mounted on a lower end of each leg. Each roller cone bit PCD insert 106 comprises the construction described above. The PCD inserts 106 are provided at desired locations on the surfaces of the cutter cone 106 or on other locations of the bit as called for by the particular end-use application, e.g., for bearing on a subterranean formation being drilled.

Figure 9:
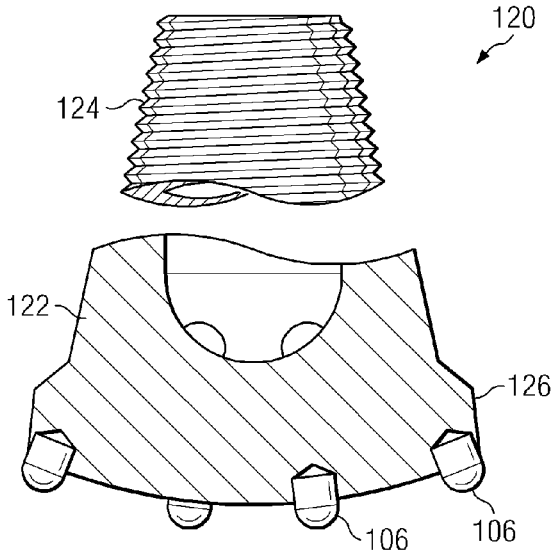
FIG. 9 is a perspective side view of a percussion or hammer bit comprising a number of the PCD inserts of FIG. 7.

Referring to FIG. 9, PCD inserts 106 of this invention can also be used with a percussion or hammer bit 120, comprising a hollow steel body 122 having a threaded pin 124 on an end of the body for assembling the bit onto a drill string (not shown) for drilling oil wells and the like. A plurality of the PCD inserts 106 are provided in the surface of a head 126 of the body 122 for bearing on the subterranean formation being drilled.

Although, limited embodiments of PCD inserts, and constructions used to form the same, have been described and illustrated herein, many modifications and variations will be apparent to those skilled in the art. Accordingly, it is to be understood that within the scope of the appended claims, PCD carbide composites of this invention may be embodied other than as specifically described herein.

What is claimed is:

1. A polycrystalline diamond wear element comprising:

a body comprising a plurality of bonded together diamond grains, and a binder phase dispersed among the diamond grains, wherein the amount of the binder phase at a first position in the body adjacent a surface of the body is about 5 to 20 percent by weight, and the amount of the binder phase at a second position in the body remote from the surface is about 15 to 40 percent by weight, wherein at least the first position of the diamond body is substantially free of added carbide;

a polycrystalline diamond transition material joined to the body and comprising a binder phase and a carbide material, wherein the content of the binder phase in the transition material is less than that of the body second position; and a substrate attached to the transition material, wherein the substrate can be selected from the group of materials consisting of metals, ceramics, cermets, and combinations thereof, and wherein the transition material is interposed between the body and the substrate.

2. The diamond wear element as recited in claim 1 wherein the binder phase comprises a binder material selected from Group VIII of the Periodic table.

3. The polycrystalline diamond wear element as recited in claim 2 wherein the binder material is Cobalt.

4. The polycrystalline diamond wear element as recited in claim 2 wherein the body first and second positions are disposed within a common region of the diamond body.

5. The polycrystalline diamond wear element as recited in claim 1 wherein the content of the binder phase between the body first and second positions changes in a gradient manner.

6. The polycrystalline diamond wear element as recited in claim 1 wherein the change in the amount of the binder phase occurs between two or more distinct regions within the body.

7. The polycrystalline diamond wear element as recited in claim 6 wherein the interface between adjacent regions is nonplanar.

8. The polycrystalline diamond wear element as recited in claim 1 wherein the body first position is within a first region of the body, and the body second position is within a second region of the body, and wherein the first and second regions have a combined thickness of from about 150 to 1,850 microns.

9. The polycrystalline diamond wear element as recited in claim 8 wherein the first region has a thickness of about 125 to 600 microns, and the second region has a thickness of from about 125 to 1,250 microns.

10. The polycrystalline diamond wear element as recited in claim 8 wherein the second region is substantially free of added carbide.

11. The polycrystalline diamond wear element as recited in claim 1 wherein the transition material has a carbide content greater than about 50 percent by weight.

12. The polycrystalline diamond wear element as recited in claim 11 wherein the transition material has a carbide content of about 55 to 90 percent by weight.

13. The polycrystalline diamond wear element as recited in claim 11 wherein the second region has a carbide content of less than about 15 percent by weight.

14. The polycrystalline diamond wear element as recited in claim 1 wherein the transition material comprises a first region and a second region moving from the diamond body to the substrate, wherein the first region comprises a higher amount of the binder phase and a lower amount of carbide than the second region.

15. The polycrystalline diamond wear element as recited in claim 14 wherein the first transition material region has a carbide content of about 65 to 75 percent by weight, and wherein the second transition material region has a carbide content of about 80 to 90 percent by weight.

16. The polycrystalline diamond wear element as recited in claim 1 wherein the transition material comprises a first region and a second region moving from the diamond body to the substrate, wherein the first region comprises a lower amount of the binder phase than the second region.

17. A bit for drilling subterranean formations comprising a body and a number of cones rotatably attached thereto, wherein one or more of the cones each comprise a number of the diamond wear elements as recited in claim 1 attached thereto.

18. The bit as recited in claim 17 wherein one or more of the diamond wear elements is positioned along a heel row of the bit.

19. A bit for drilling subterranean formations, the bit including a body and a number of diamond inserts operatively attached to the body at a position to engage the subterranean formation, wherein one or more of the diamond inserts have a construction comprising:

a polycrystalline diamond body comprising bonded together diamond grains, and a binder phase dispersed among the diamond grains, wherein the body includes a first region adjacent a surface of the body comprising about 5 to 20 percent by weight of the binder phase, and the body includes a second region remote from the surface comprising about 15 to 40 percent by weight of the binder phase, wherein the binder phase changes within each body region in a gradient manner, and wherein the first region is substantially free of added carbide;

a transition region joined to the body and comprising a binder phase and a carbide material, wherein the amount of the binder phase in the transition region is less than that of the body second region; and a substrate attached to the transition region, wherein the substrate can be selected from the group of materials consisting of metals, ceramics, cermets, and combinations thereof, and wherein the transition region is interposed between the diamond body and substrate.

20. The bit as recited in claim 19 wherein the transition region comprises in the range of from about 55 to 90 percent by weight carbide material, and in the range of from about 2 to 15 percent by weight binder phase.

21. The bit as recited in claim 19 wherein the first and second region have a combined thickness of from about 150 to 1,850 microns.

22. The bit as recited in claim 19 wherein the first region has a thickness of about 125 to 600 microns, and the second region has a thickness of from about 125 to 1,250 microns.

23. The bit as recited in claim 19 wherein the second region is substantially free of added carbide.

24. The bit as recited in claim 19 wherein the transition region has carbide content of about 55 to 90 percent by weight.

25. The bit as recited in claim 19 wherein the second region has a carbide content of less than about 15 percent by weight.

26. The bit as recited in claim 25 wherein the transition region comprises greater than about 50 percent by weight carbide.

27. The bit as recited in claim 19 wherein the transition region comprises a first and second layer moving away from the body towards the substrate, and wherein the first layer has a carbide content less than the second layer.

28. The bit as recited in claim 27 wherein the transition layer first layer comprises about 65 to 75 percent by weight carbide, and the second layer comprises about 80 to 90 percent by weight carbide.

29. The bit as recited in claim 19 wherein the transition region comprises a first and second layer moving away from the body towards the substrate, and wherein the first layer has a metal binder content less than the second layer.

30. A method of making a diamond wear element comprising the steps of:

placing a first volume of diamond grains adjacent a second volume of diamond grains;

subjecting the first and second volume of diamond grains to high pressure/high temperature conditions in the presence of a binder material to form a sintered polycrystalline diamond body, the diamond body comprising a first region formed from the first volume of diamond grains and a second region formed from the second volume of diamond grains, wherein the first region is positioned adjacent a working surface of the diamond body and the content of the binder phase at the first region is about 5 to 20 percent by weight, and the content of the binder phase in the second region at a position remote from the surface is about 15 to 40 percent by wherein at least the first region of the diamond body is substantially free of added carbide;

subjecting a third volume of diamond grains to high pressure/high temperature conditions in the presence of a binder material to form a sintered polycrystalline diamond material comprising a carbide material and a binder material to form a transition region, wherein the amount of the binder material in the transition region is less than that in the body second region; and attaching the transition material to a cermet substrate, wherein the transition region is interposed between the body and the substrate.

31. The method as recited in claim 30 wherein the second volume is substantially free of added carbide.

32. The method as recited in claim 30 wherein transition region comprises greater than 50 percent by weight carbide.

33. The method as recited in claim 32 wherein the transition region comprises about 55 to 90 percent by weight carbide.

34. The method as recited in claim 32 wherein the second region has a carbide content of less than about 15 percent by weight.

* * * * *